US006149472A

United States Patent [19]

Endo et al.

[11] Patent Number: 6,149,472

[45] Date of Patent: Nov. 21, 2000

[54] ELECTRICAL TERMINAL

[75] Inventors: Takayoshi Endo; Kazuhisa Ishizaki; Kenichi Okamoto, all of Shizuoka, Japan

[73] Assignee: Yazaki Corporation, Tokyo, Japan

[21] Appl. No.: 09/392,226

[22] Filed: Sep. 9, 1999

[30] Foreign Application Priority Data

Sep. 10, 1998 [JP] Japan ..... 10-256267

[51] Int. Cl.[7] ..... H01R 13/434

[52] U.S. Cl. ..... 439/745

[58] Field of Search ..... 439/745, 744, 439/733.1, 871, 872, 873, 891, 937, 595, 603, 751

[56] References Cited

U.S. PATENT DOCUMENTS 4,333,703 6/1982 Anhalt et al. ..... 339/217

5,934,945 8/1999 Petersen et al. ..... 439/744

*Primary Examiner*—Renee Luebke

*Assistant Examiner*—Phuongchi Nguyen

*Attorney, Agent, or Firm*—Armstrong, Westerman, Hattori, McLeland & Naughton

[57] ABSTRACT

An electrical terminal for use with a resin-made connector housing containing a locking lance, consists of a terminal body having a collar projecting circumferentially therearound, and a locking member separate from the terminal body. The locking member has engagement means engageable with the collar to retain the locking member longitudinally in place on the terminal body. The locking member engages with the locking lance to lock the terminal in the connector housing. The locking member is made of resin so that during moving the terminal into and out of the connector housing, resin is prevented from being shaved off from the connector housing including the locking lance.

6 Claims, 7 Drawing Sheets

ELECTRICAL TERMINAL

BACKGROUND OF THE INVENTION

1. Field of the Invention

This invention relates to an electrical terminal for use in an electric vehicle.

2. Description of the Related Art

An electrical terminal as shown in FIG. 9 is conventionally proposed in Japanese Patent Application Unexamined Publication No. 8-264224.

This terminal 80 is formed by pressing a not-shown metallic plate and has a terminal body 81, a pin-like electrical contact 82 and cable connection flaps 83 provided respectively at the front and rear ends of the terminal body 81, and a flange-like locking member 84 located at an intermediate length of the terminal body.

As shown in FIG. 10, the connector 85 which receives the terminal 80 includes a housing 86 of synthetic resin with a terminal receiving cavity 87 formed therein, a terminal receiving cavity having a locking lance 88 projecting therein.

The terminal 80, after its flaps 83 are crimped on the cable 89, is inserted into the terminal receiving cavity 87 until the locking projection 88*a* of the locking lance 88 engages with the rear end edge 84*a* of the locking member 84.

However, because the rear end edge 84*a* of the locking member 84 is sharp and slides on the inner surface 87*a* of the housing 86 during insertion of the terminal 80 into the terminal receiving cavity 87, it has been possible that the rear end edge 84*a* shaves resin off the lance 88. If such shavings adhere to the electrical contact 82, a contact failure or the like will be disadvantageously caused inside the housing 86, between the terminal 80 and a mating terminal (not shown).

SUMMARY OF THE INVENTION

This invention has been accomplished to overcome the above drawback and an object of this invention is to provide a terminal which prevents shaving or scraping of the inner surface of a terminal receiving cavity and/or the locking lance during moving the terminal into and out of the terminal receiving cavity.

In order to attain the object, according to this invention, there is provided an electrical terminal for use with a resin-made connector housing with a terminal receiving cavity formed therein, the terminal receiving cavity containing a locking lance, which comprises: a terminal body having a collar projecting around an outer periphery of the terminal body; and a locking member separate from the terminal body, which is provided with an engagement means engageable with the collar to retain the locking member longitudinally in place on the terminal body, the locking member being engageable with the locking lance of the connector housing to lock the terminal body in the terminal receiving cavity, wherein the locking member is made of resin such that during moving the electrical terminal into and out of the terminal receiving cavity, resin is prevented from being shaved off from the connector housing including the locking lance.

The locking member, which is separate from the terminal body, is made of resin and retainable longitudinally in place on the terminal body due to the structure mentioned above.

Preferably, the engagement means engageable with the collar comprises at least one pair of engagement projections longitudinally spaced from each other with a space therebetween for receiving the collar.

Preferably, the locking member comprises a longitudinally elongated ring body, a flange provided circumferentially at a longitudinal position on the ring body and engageable with the locking lance of the connector housing, and the engagement means engageable with the collar comprises at least one pair of engagement ribs provided longitudinally spaced on an inner surface of the ring body.

Preferably, four pairs of the engagement ribs are provided on the inner surface of the ring body.

Preferably, the flange is provided at an end of the ring body toward the connector housing.

Preferably, the ring body has at an opposite end thereof resilience which enables riding over the collar around the terminal body.

Preferably, the ring body is movable on the terminal body, with top surfaces of the engagement ribs sliding on the outer periphery of the terminal body.

The above and other objects, features and advantages of this invention will become apparent from the following description and the appended claims, taken in conjunction with the accompanying drawings.

DESCRIPTION OF THE PREFERRED EMBODIMENT

An embodiment of this invention will now be described with reference to the attached drawings.

FIGS. 1 to 8 show one embodiment of a terminal according to this invention.

Figure 1:
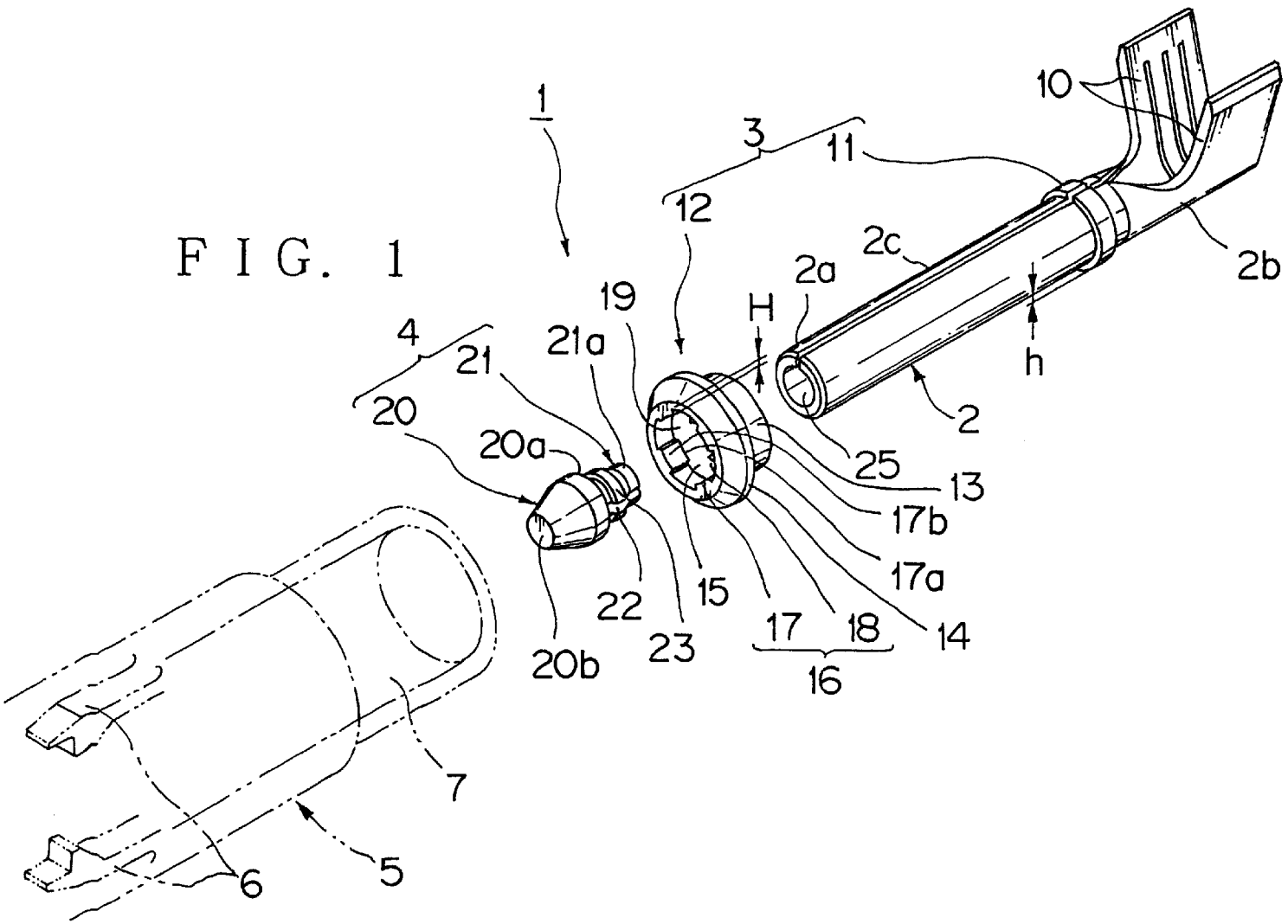
FIG. 1 is an exploded perspective view of a terminal according to one example of this invention.

In FIG. 1, the terminal 1 includes a cylindrical terminal body 2 with a collar 11 therearound and a locking member 12 which engages with the collar 11 to be retained around the terminal body 2. The terminal 1 is removably insertable into a terminal receiving cavity 7 of a connector housing 5. The locking member 12 engages with a locking lance 6 to lock the terminal 1 in the terminal receiving cavity 7.

Figure 2:
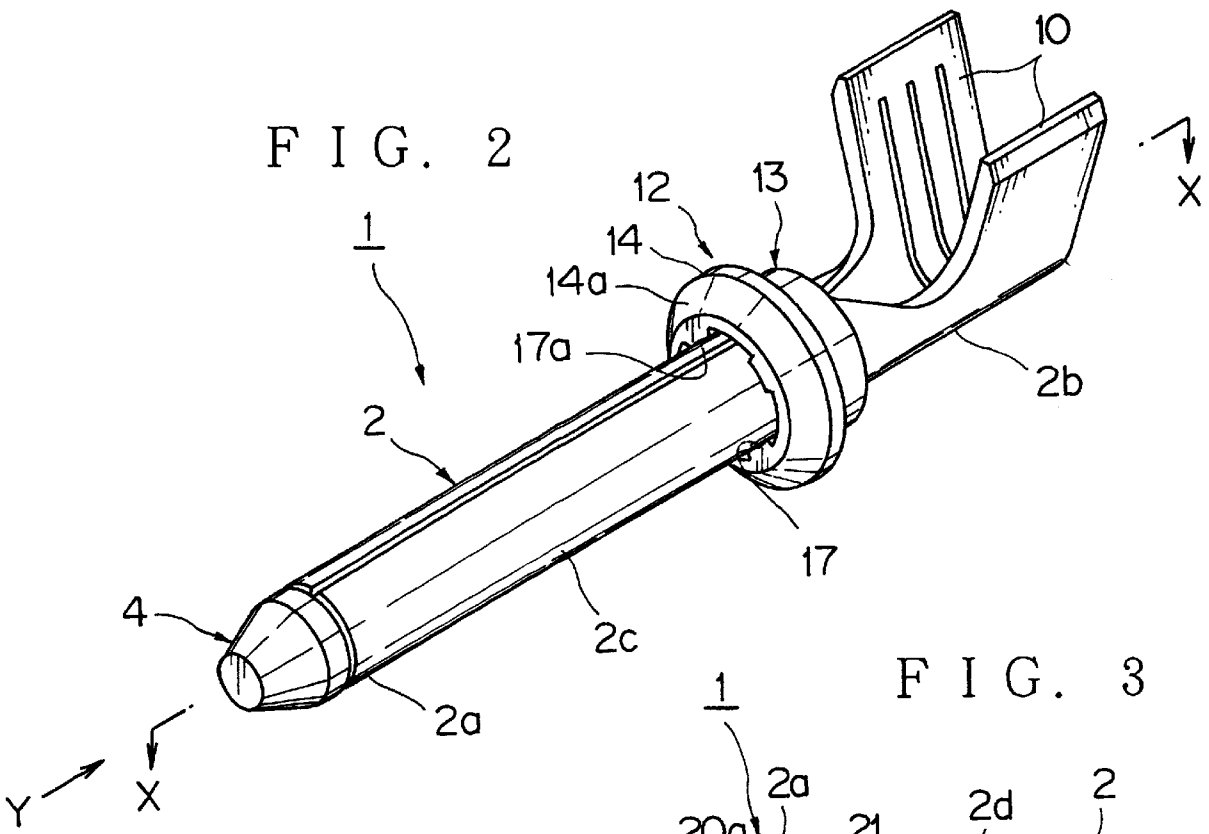
FIG. 2 is a perspective view of the terminal as in FIG. 1.

The terminal body 2 is provided by pressing a metallic plate (not shown). As shown in FIGS. 1 and 2, the terminal body 2 is at the front end 2*a* removably fitted with a cap member 4 of synthetic resin and at the rear end 2*b* integrally provided with a pair of cable connection flaps 10, 10. The projecting collar 11 is formed through pressing circumferentially around the outer periphery of the terminal body 2 near its rear end 2*b*.

The locking member 12, which is separate from the terminal body 2, is made of resin and is adapted to hold the collar 11 to be retained longitudinally in place on the terminal body 2.

Figure 4:
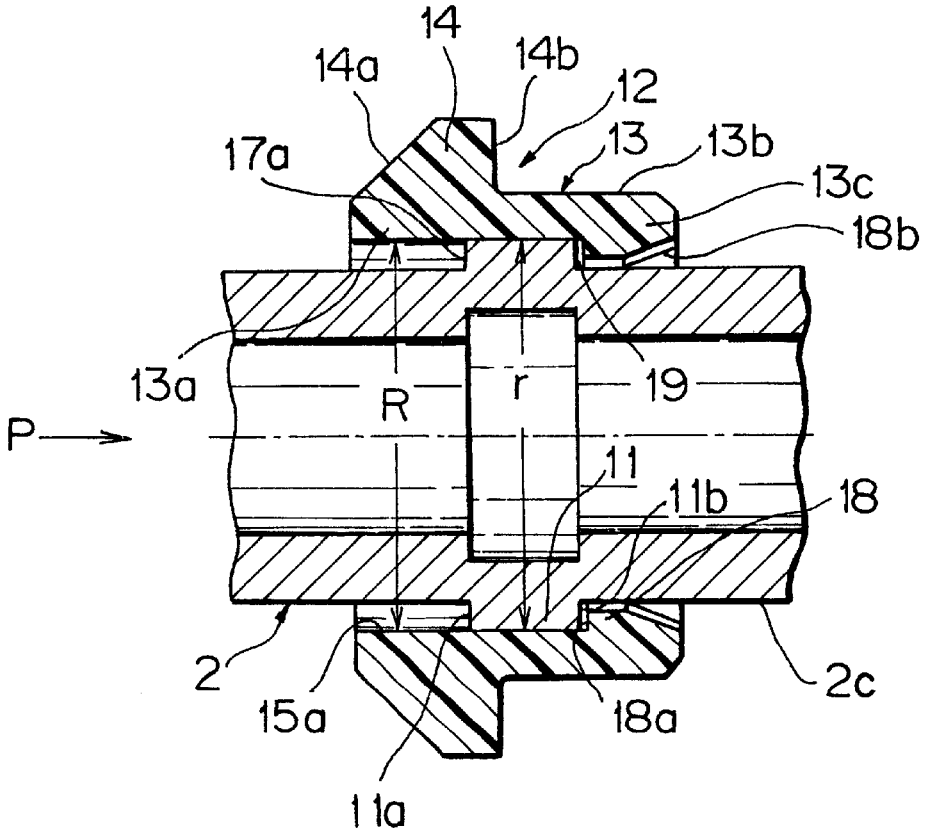
FIG. 4 is an enlarged section of a locking member as in FIG. 3.
Figure 5:
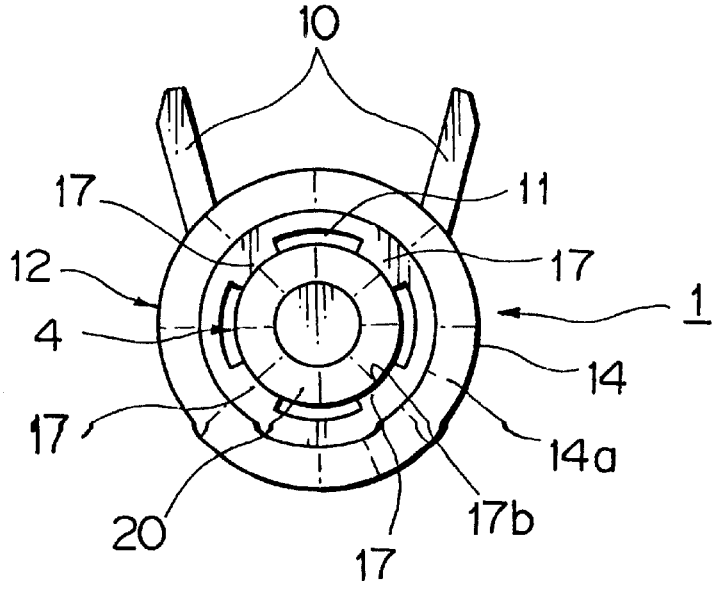
FIG. 5 is a view taken from the direction of an arrow Y in FIG. 2.

As shown in FIGS. 1, 4 and 5, the locking member 12 includes a longitudinally-elongated ring body 13, a flange 14 provided circumferentially around the outer peripheral wall 13*b* of the ring body 13 at a front portion 13*a* thereof, and engagement ribs 16 formed projecting on an inner wall of the ring body 13. The ring body 13 has a throughhole 15 for insertion therethrough of the terminal body 2 and is slidable on the outer peripheral wall 2*c* of the terminal body 2. The flange 14 is circumferentially formed with an inclined surface 14*a* at the front end side and with a stopper surface 14*b* at the rear end which extends substantially perpendicularly to the outer peripheral wall 13*b* of the ring body 13. The ring body 13 is resilient especially at the rear end 13*c*. The ring body 13 is preferably formed at the rear end 13*c* with a slit, notch or the like which extends in a fitting direction P of the locking member 12 over the terminal body 2, so as to increase its resilience.

As shown in FIGS. 1 and 4, the engagement ribs 16 include first ribs 17 and second ribs 18 located on the inner circumferential wall 15*a* of the ring body 13 at the front end side and the rear end side, respectively, with a spacing 19 therebetween for receiving the collar 11 on the cylindrical terminal body 2. More specifically, the spacing 19 is formed between the rear end surface 17*a* of the first ribs 17 and the front end surface 18*a* of the second ribs 18. The second ribs 18 each has an upwardly inclined surface 18*b* at the rear end side.

The inner diameter R of the throughhole 15 is substantially equal to or slightly larger than the outer diameter r of the collar 11 ($R \geqq r$). The height H (FIG. 1) by which the first ribs 17 project from the inner circumferential surface 15*a* of the ring body 13 is substantially equal to or slightly larger than the height h (FIG. 1) by which the collar 11 projects from the outer peripheral surface 2*a* of the terminal body 2 ($H \geqq h$). The locking member 12 is movable on the terminal body 2, with top surfaces 17*b* of the first ribs 17 sliding on the outer peripheral surface 2*c* of the terminal body 2.

As shown in FIGS. 1 and 5, there are provided four first ribs 17 angularly equally spaced from one another. Likewise, there are provided four second ribs 18 angularly equally spaced from one another, at positions corresponding to spacings between neighboring first ribs 17. This arrangement serves to facilitate the molding of the member 12 from resin. A change may optionally be made, if desired, in the number and positional arrangement of the first and/or second ribs 17, 18.

Figure 3:
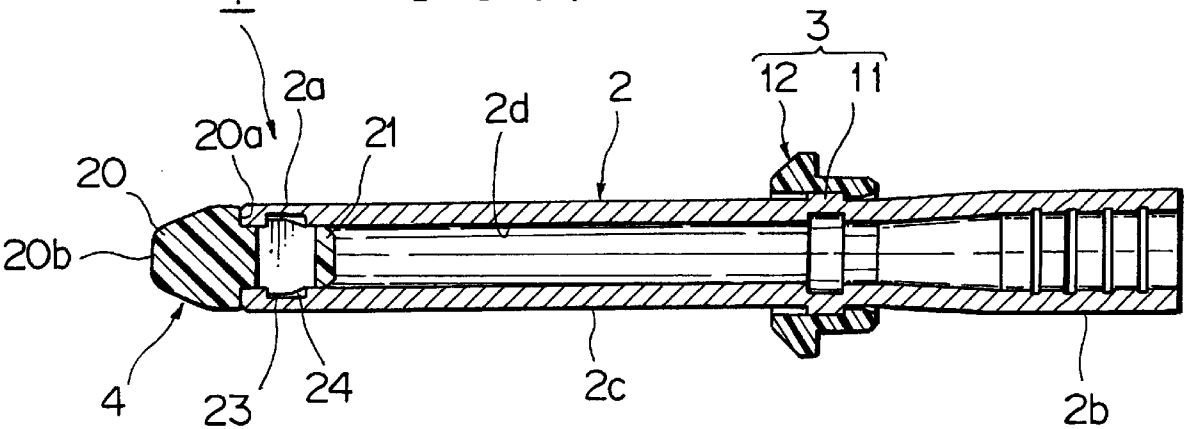
FIG. 3 is a section taken along the line X—X of FIG. 2.

As shown in FIGS. 1 and 3, the cap member 4 includes a truncated cone-shaped element 20 and a rod-like element 21 adjoining the cone-shaped element 20 at the bottom surface 20*a*. The axes of the cone-shaped element 20 and the rod-like element 21 coincide with each other. The cone-shaped element 20 has a flat surface 20*b* at the tip end. The rod-like element 21 has notches or cutouts 22 extending parallel to its center axis and a circumferential locking projection 23 on its outer peripheral wall 21*a* which engages in a corresponding circumferential groove 24 formed in the inner circumferential wall 2*d* of the terminal body 2.

Figure 7:
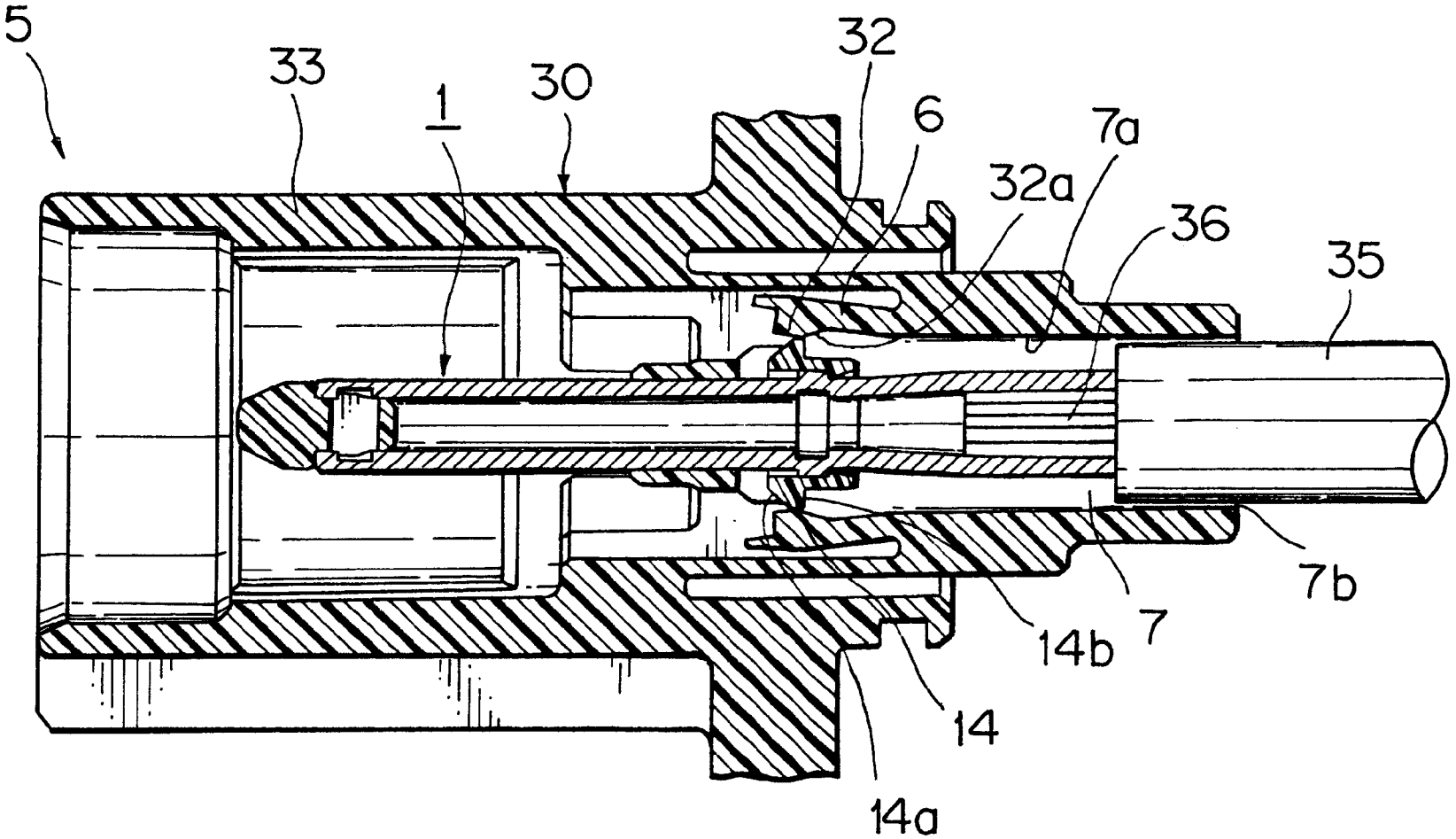
FIG. 7 is a section showing the terminal inserted into a connector housing, but not yet in a locked position by a locking lance.

As indicated in FIG. 7, the connector 5 which receives the terminal 1 is made of resin and includes a housing 30 with a terminal receiving cavity 7 formed therein, and a resilient locking lance 6 provided on the inner surface 7*a* defining the terminal receiving cavity 7, the locking lance 6 having a locking projection 32 at its free end. The housing 30 has, at the rear end opposite the end through which the terminal 1 is inserted, a hood 33 for receiving a not-shown mating connector.

The method of assembling the terminal 1 will now be described.

As shown in FIG. 1, the rod-like element 21 of the cap member 4 is fitted in the terminal body 2 at the front end 2*a* and, as shown in FIG. 3, its circumferential locking projection 23 is engaged in the circumferential groove 24 of the terminal body 2 to assemble the cap member 4 to the terminal body 2.

Figure 6:
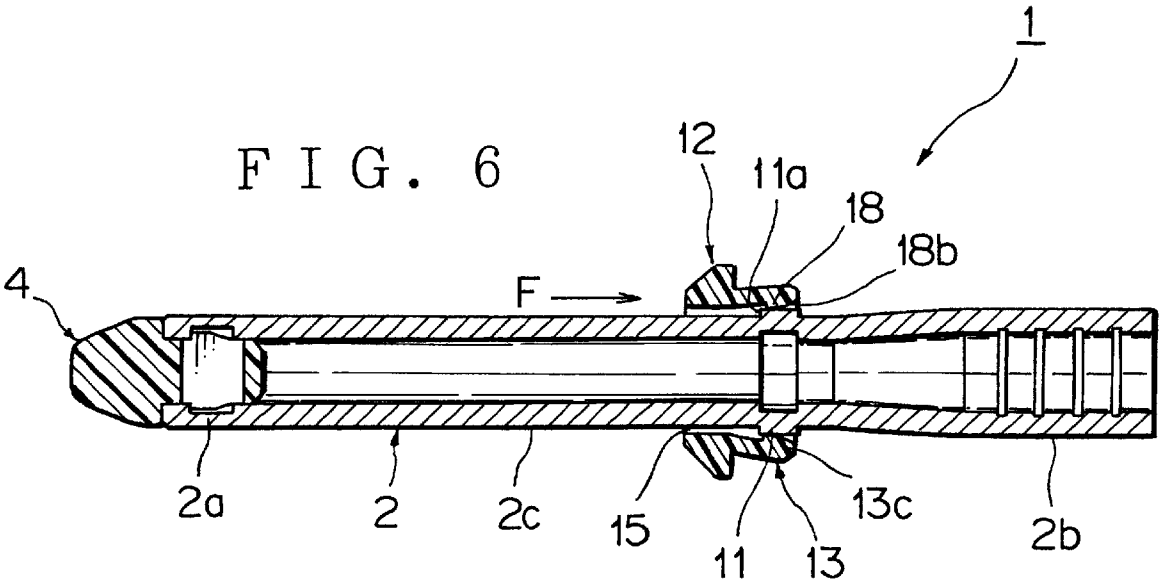
FIG. 6 is a section similar to FIG. 3, showing the locking member riding over a collar provided around the terminal body.
Figure 9:
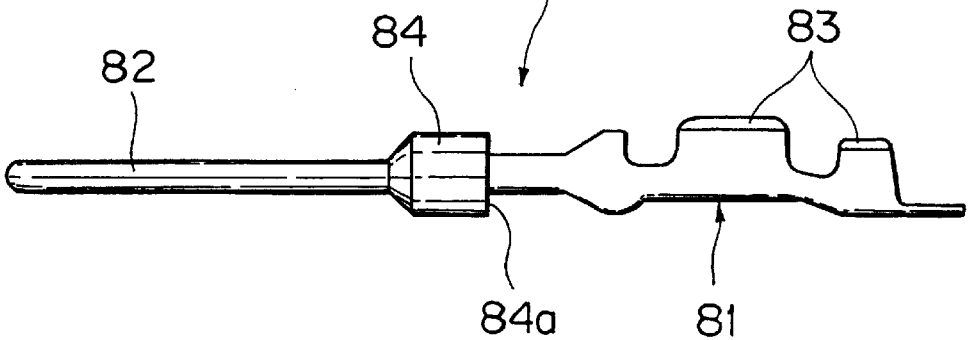
FIG. 9 PRIOR ART
FIG. 9 is a view of a conventional terminal.

As shown in FIG. 6, the terminal body 2 is inserted at the front end 2*a* into the throughhole 15 of the locking member 12, and an external force F is applied to move the locking member 12 toward the rear end 2*b* of the terminal body 2, at which time the top surfaces 17*a* of the locking member first ribs 17 slide on the outer peripheral surface 2*c* of the terminal body 2. As shown in FIG. 6, the inclined surfaces 18*b* of the locking member second ribs 18 then come into contact with the collar 11 to have the second ribs 18 and thus the rear end 13*c* of the ring body 13 expand circumferentially outwardly.

As shown in FIGS. 3 and 4, concurrently with the rear end surfaces 17*a* (FIG. 1) of the first ribs 17 abutting against the front end surface 11*a* of the collar 11, the second ribs 18 ride over the collar 11 and restore their original position, so that their front end surfaces 18*a* engage with the rear end surface 11*b* of the collar 11. Thus, the collar 11 is held between the first and second ribs 17 and 18, with its front end surface 11*a* engaged by the rear end surfaces 17*a* of the first ribs 17 and its rear end surface 11*b* engaged by the front end surfaces 18*a* of the second ribs 18, leading to a secure retention of the ring member 12 in position on the terminal body 2. The terminal 1 is thus assembled.

As shown in FIGS. 1 and 7, the flaps 10 of the terminal 1 are crimped on the conductor 36 of the cable 35, which involves a pretty large force acting on the terminal body 2. The terminal body 2, however, is kept from deformation owing to the locking member 12 fitted therearound and serving to strengthen same.

Figure 8:
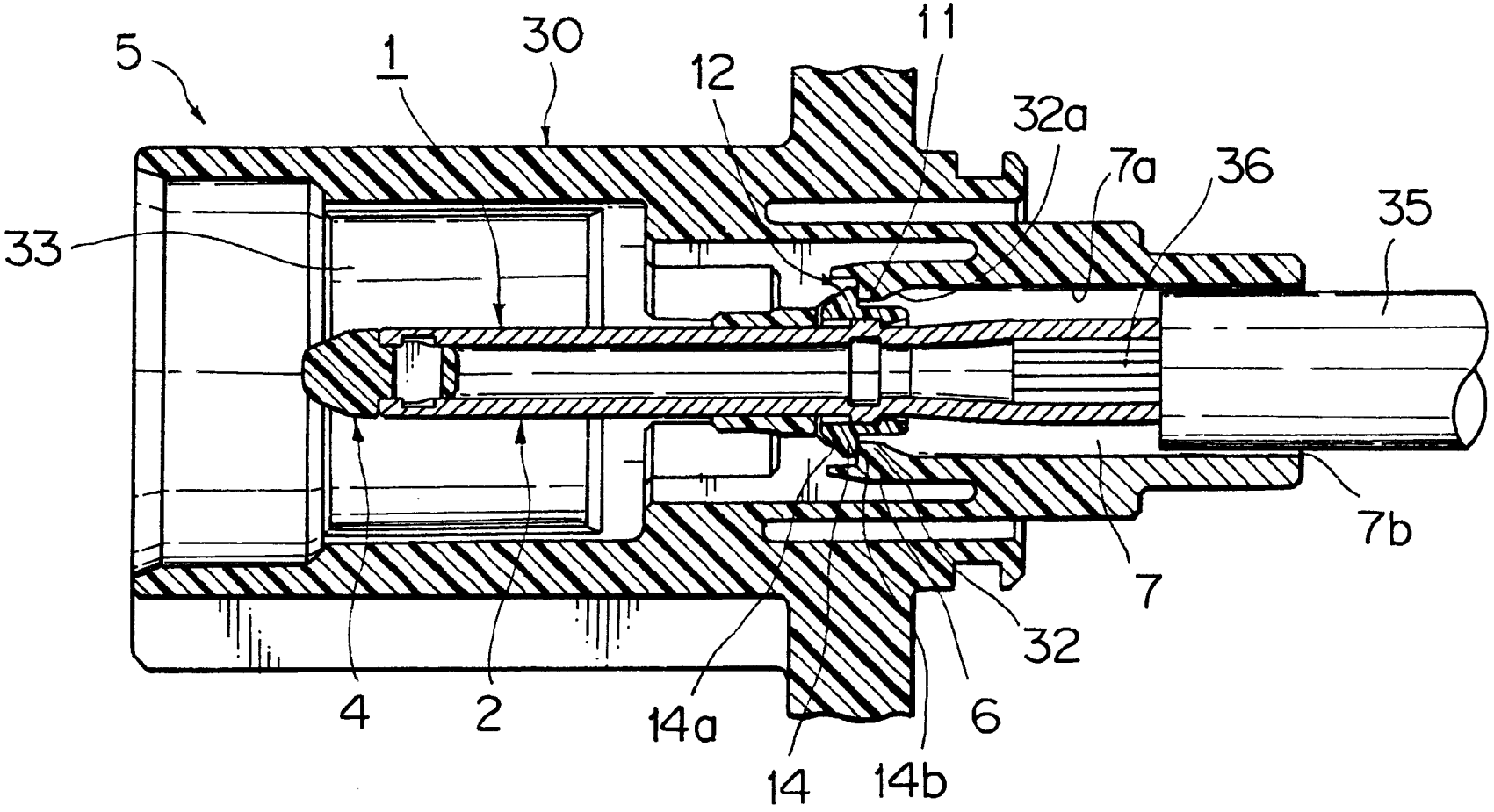
FIG. 8 is a section similar to FIG. 7, showing the terminal in a locked position by the locking lance.
Figure 10:
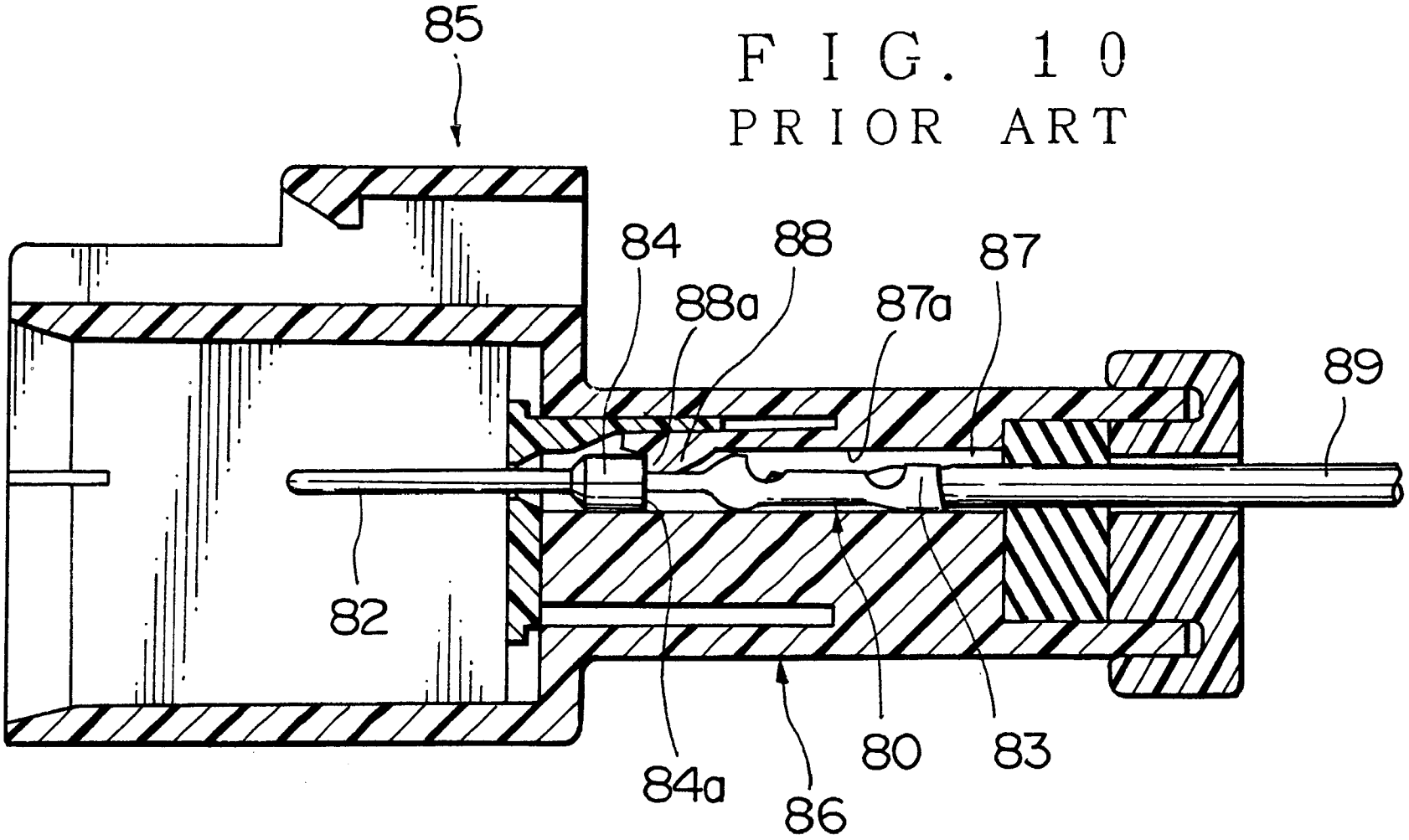
FIG. 10 PRIOR ART
FIG. 10 is a section showing the terminal as in FIG. 9, inserted into a connector housing.

Referring now to FIGS. 7 and 8, the operation of the locking member 2 when inserting the terminal 1 attached with the cable 35 into the connector housing 30 will now be described.

The terminal 1, its front end first, is pushed through the opening 7*b* into the terminal receiving cavity 7.

On its abutting against the locking projections 32 of the locking lances 6, the inclined surface 14*a* of the flange 14 gradually pushes and deflects the locking lances 6 outwardly. The locking lances 6 are restored to their original position when the flange 14 has passed therethrough, thereby bringing their locking projections 32 into contact with the stopper surface 14*b* of the flange to lock the terminal 1 from slipping off rearwardly.

Until when the terminal 1 comes to the locked position by the locking lances 6, the flange 14 of the terminal 1 slides on the inner surface 7*a* of the terminal receiving cavity 7 and edges 32*a* of the locking projections 32. However, because the locking member 12 and the connector housing 30 inclusive of the locking projections 32 are made of resin, shaving or scraping of resin off the terminal receiving cavity inner surface 7*a* and the locking projection edges 32*a* is prevented, thus causing no shavings which, especially those adhering to the electrical-contact-making front end 2*a* of the terminal 2, would cause a contact failure with a mating terminal as in the described related art. A contact failure is thus prevented.

Further, because the locking projections 32 are not scraped or deformed by the flange 14, the terminal 1 can be reliably locked in position by the locking lances 14.

The advantage as mentioned above can also be attained, more or less, when pulling the terminal 1 out of the terminal receiving cavity 7 of the connector 5.

It is to be noted that the resin-made locking member 12 can be easily and reliably retained on the terminal body 2 through cooperation of the locking member 12 having the structural features as described above with the collar 11 provided circumferentially around the terminal body 2.

Having now fully described the invention, it will be apparent to one of ordinary skill in the art that many changes and modifications can be made thereto without departing from the spirit and scope of the invention as set forth herein.

What is claimed is:

1. An electrical terminal for use with a resin-made connector housing with a terminal receiving cavity formed therein, said terminal receiving cavity containing a locking lance, comprising:

a terminal body having a collar projecting around an outer periphery of said terminal body; and a locking member separate from said terminal body, which is provided with an engagement means engageable said collar to retain said locking member longitudinally in place on said terminal body, said locking member being engageable with said locking lance of said connector housing to lock said terminal body is said terminal receiving cavity, wherein said locking member is made of resin such that during moving said electrical terminal into and out of said terminal receiving cavity, resin is prevented from being shaved off from said connector housing including said locking lance, wherein said engagement means engageable with said collar comprises at least one pair of engagement ribs longitudinally spaced from each other with a space therebetween for receiving said collar.

2. The electrical terminal according to claim 1, wherein said locking member comprises a longitudinally elongated ring body, and a flange provided circumferentially at a longitudinal position on said ring body and engageable with said locking lance of said connector housing.

3. The electrical terminal according to claim 2, wherein four pairs of said engagement ribs are provided on said inner surface of said ring body.

4. The electrical terminal according to claim 2 or 3, wherein said ring body is movable on said terminal body, with top surfaces of said engagement ribs sliding on said outer periphery of said terminal body.

5. The electrical terminal according to claim 2, wherein said flange is provided at an end of said ring body toward said connector housing.

6. The electrical terminal according to claim 5, wherein said ring body is resilient and has at an opposite end, which enables riding over said collar around said terminal body.

* * * * *